US006824457B2

(12) United States Patent
Himeno et al.

(10) Patent No.: US 6,824,457 B2
(45) **Date of Patent: *Nov. 30, 2004**

(54) ANGLE MEASUREMENT DEVICE

(75) Inventors: Kazuko Himeno, Sapporo (JP); Hiroshi Himeno, Sapporo (JP)

(73) Assignee: Kazuko Himeno, Sapporo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/029,963

(22) Filed: Dec. 31, 2001

(65) Prior Publication Data

US 2002/0061721 A1 May 23, 2002

(51) Int. Cl.[7] ..... B24B 41/06
(52) U.S. Cl. ..... 451/364; 451/371; 451/321; 451/164
(58) Field of Search ..... 451/364, 371, 451/321, 164

(56) References Cited

U.S. PATENT DOCUMENTS 2,324,025 A * 7/1943 Revell ..... 451/164
2,391,260 A * 12/1945 Miller ..... 451/164
4,303,054 A * 12/1981 Lore ..... 125/11.01
4,509,268 A * 4/1985 Marquam et al. ..... 33/201
4,821,462 A * 4/1989 Moore ..... 451/555
6,146,257 A 11/2000 Himeno et al. ..... 451/321

* cited by examiner

*Primary Examiner*—Joseph J. Hail, III
*Assistant Examiner*—Alvin J. Grant
(74) *Attorney, Agent, or Firm*—Birch, Stewart, Kolasch & Birch, LLP

(57) ABSTRACT

An angle-measurement assist device suitable for a visual inspection to determine a blade angle of a dental scaler is provided with a holder having a flat face thereof adapted to be in contact with a bladed portion of the scaler, a permanent magnet mounted to the holder, and first, second and third pins projecting from the holder in the directions which are perpendicular to one another, whereby an operator is permitted to make a visual inspection to determine whether the scaler is sharpened to have a target blade angle on the basis of an extending direction of the first pin, with the assist device magnetically retained on the scaler.

18 Claims, 7 Drawing Sheets

ANGLE MEASUREMENT DEVICE

BACKGROUND OF THE INVENTION

1. Technical Field

The present invention relates to an angle measurement device, and more particularly, to an angle measurement device for measuring a blade angle of a dental instrument and an angle-measurement assist device therefor.

2. Related Art

In dental treatments, various types of bladed dental instruments are employed. Especially, scalers are widely employed for scaling tartar and dental plaque on the teeth and for root-planing periodontal faces of the teeth. A scaler has a handle grasped by an operator and a shank extending therefrom and having a distal end portion thereof formed with a bladed portion of a semi-cylindrical shape in cross section. The bladed portion has a flat upper face and a semi-cylindrical face that has flat opposite edge portions crossing the flat upper face to form two ridge lines which constitute two tips of the blade. To meet conditions for dental treatments which vary in dependence on types of dental treatments as well as shapes and parts of the teeth subject to dental treatments, a distal half of the shank is formed into a simple straight-line shape, a complicated shape curved in three dimensions, or the like.

In order to efficiently carry out dental treatments such as scaling and root planing to enhance therapeutic effects, it is important to maintain the sharpness of a scaler. When a scaler is in use, however, the sharpness of the scaler blade is liable to be deteriorated. Thus, the sharpness of the scaler blade is checked before and during the use of the scaler, and the scaler is sharpened manually or with the use of an electric sharpening apparatus, as required, to maintain a desired sharpness.

A typical electric sharpening apparatus, having a sharpening stone rotated by an electric motor and adapted to be pressed against the scaler, can excessively sharpen the scaler blade and cannot achieve easy sharpening during the dental treatment. On the contrary, manual sharpening can be carried out with ease during the dental treatment by sliding a sharpening stone along a scaler. However, manual sharpening requires skills since the scaler blade is extremely small having about a 2.0 mm length and about a 0.5 mm thickness at the minimum and the scaler may have a complicated shape as mentioned above. Thus, it is difficult for an unskilled operator to uniformly and smoothly sharpen the entirety of the scaler blade.

In this respect, the present inventors proposed a manually-operated sharpening apparatus as disclosed in Japanese provisional patent publication no. 2000-24889, which permits easy sharpening of a bladed dental instrument. However, difficulties are encountered in making a visual inspection to promptly and accurately determine whether a dental instrument is sharpened to have a proper blade angle.

SUMMARY OF THE INVENTION

An object of the present invention is to provide an angle-measurement assist device for assisting a visual angle measurement with respect to a measurement object having a portion made of a magnetic material.

Another object of the present invention is to provide an angle measurement device for promptly and easily carrying out an angle measurement with accuracy with respect to such a measurement object.

Still another object of the present invention is to provide a manually-operated sharpening apparatus provided with an angle measurement device of the just-mentioned type.

According to one aspect of the present invention, there is provided an angle-measurement assist device which comprises: a holder having a first flat face thereof adapted to be in contact with a measurement object portion of a measurement object, the measurement object portion being subject to an angle measurement and made of a magnetic material; a permanent magnet mounted to said holder for permitting said device to be magnetically retained on the measurement object portion; and a straight member projecting from a second face of said holder and having a size sufficiently greater than that of the measurement object portion.

According to the angle-measurement assist device of this invention, when the holder mounted with the permanent magnet is in contact at its first flat face with a measurement object portion made of a magnetic material, the assist device is magnetically retained on the measurement object portion and the first flat face of the holder extends in substantially the same direction as an extending direction of the measurement object portion. Since the straight member has a size sufficiently greater than that of the measurement object portion and extends at a known angle relative to the first face of the holder, an operator is enabled to make a visual inspection to determine an angle of the measurement object portion, which angle is indicated under magnification by the extending direction of the straight member.

In the present invention, preferably, said straight member extends in parallel with the first flat face of said holder. According to this preferred embodiment, the straight member of the assist device retained on the measurement object portion extends substantially the same direction as an extending direction of the measurement object portion, so that an operator is permitted to make a visual measurement on the angle of the measurement object portion based on the extending direction of the straight member.

More preferably, the measurement object is a dental scaler having a handle adapted to be grasped by an operator and a shank extending therefrom and having a distal end portion thereof formed with a bladed portion which constitutes the measurement object portion. With this preferred embodiment, a visual measurement on the blade angle of the scaler can be made based on the extending direction of the straight member of the assist device retained on the bladed portion of the scaler.

According to another aspect of the present invention, there is provided an angle measurement device which comprises an angle-measurement assist device and a scale plate. The assist device comprises: a holder having a first flat face adapted to be in contact with a measurement object portion of a measurement object, the measurement object portion being subject to an angle measurement, made of a magnetic material, and provide in a distal end portion of a shank of the measurement object which extends from the main body of the shank at a shank angle; a permanent magnet mounted to said holder for permitting said assist device to be magnetically retained on the measurement object portion; and a straight member projecting from a second face of said holder and sufficiently greater in size than the measurement object portion. The scale plate has a central portion thereof formed with a hole permitting the distal end portion of the shank to pass therethrough and is provided with a first scale indicative of a target positioning angle for the main body of the shank and a second scale indicative of a target angle of the measurement object portion which is to be established when the main body of the shank is positioned at the first scale.

Preferably, the angle measurement device further includes a base plate for supporting the scale plate in a state that the scale plate vertically extends from the base plate.

According to the angle measurement device of this invention, an operator is enabled to easily and accurately determine whether the angle of the measurement object portion such as a blade angle coincides with a target angle on the basis of an extending direction, relative to the second scale, of the straight member of the assist device retained on the measurement object portion, with the main body of the shank of the measurement object positioned at the target angle indicated by the first scale and the distal end portion of the shank passing through the hole of the scale plate.

According to still another aspect of the present invention, there is provided an angle measurement device which comprises an angle-measurement assist device and a base plate. The angle-measurement assist device comprises: a holder having a first flat face thereof adapted to be in contact with a measurement object portion of a measurement object, the measurement object portion being subject to an angle measurement, made of a magnetic material, and provided in a distal end portion of a shank of the measurement object which extends from a main body of the shank at a shank angle; a permanent magnet mounted to said holder for permitting said angle-measurement assist device to be magnetically retained on the measurement object portion; and a straight member projecting from a second face of said holder and having a size sufficiently greater than that of the measurement object portion. The base plate is provided with a first scale indicative of a target positioning angle for the main body of the shank and a second scale indicative of a target angle of the measurement object portion which is to be established when the main body of the shank is positioned at the first scale.

Preferably, first and second lines serving as the first and second scales are drawn on the base plate. Alternatively, the angle measurement device includes a scale plate provided with the first and second scales and adapted to be disposed on the base plate.

According to the angle measurement device of this invention, an operator is enabled to determine whether the angle of the measurement object portion coincides with a target angle on the basis of an extending direction of the straight member of the assist device retained on the measurement object portion, with the main body of the shank of the measurement object positioned at the first scale.

Alternatively, the base plate is provided with angle graduations instead of the second scale. With such an angle measurement device, a visual measurement on the angle of the measurement object portion can be made by comparing the angle graduations with an extending direction of the straight member of the assist device retained on the measurement object positioned at the first scale.

In the angle measurement device of this type, preferably, a rod member is disposed on the base plate so as to be pivotable around one end of the rod member. More preferably, an arcuate member is fixed on the base plate, and another end of the rod member moves along the arcuate member as the rod member is pivoted. With this preferred embodiment, a visual measurement on the angle of the measurement object portion can be made by pivoting the rod member to coincide with an extending direction of the straight member of the assist device retained on the measurement object positioned at the first scale and then comparing the angle graduations with the extending direction of the rod member which indicates the extending direction of the straight member.

According to still another aspect of the present invention, there is provided a manually-operated sharpening apparatus which comprises a sharpening section, an angle-measurement assist device, and a scale plate. The sharpening section includes a base plate having a substantially flat face; a sharpening member for sharpening a workpiece portion of a workpiece, the workpiece portion to be sharpened being made of a magnetic material and provided in a distal end portion of a shank of the workpiece extending from a main body of the shank at a shank angle; a guide member, fixed on the substantially flat face of the base plate, for guiding the sharpening member attached thereto so as to permit the sharpening member to move therealong; a positioning-assist element including a positioning line drawn on the substantially flat face of the base plate and extending at a predetermined angle with respect to the guide member, for permitting an operator to orient the workpiece in a state where the predetermined angle is formed between the workpiece portion and the sharpening member. The angle-measurement assist device includes: a holder having a first flat face thereof adapted to be in contact with the workpiece portion to be subject to an angle measurement; a permanent magnet mounted to said holder for permitting said angle-measurement assist device to be magnetically retained on the workpiece portion; and a straight member projecting from a second face of said holder and having a size sufficiently greater than that of the workpiece portion. The scale plate has a central portion thereof formed with a hole permitting the distal end portion of the shank to pass therethrough, and is provided with a first scale indicative of a target positioning angle for the main body of the shank and a second scale indicative of a target angle of the measurement object portion which is to be established when the main body of the shank is positioned at the first scale.

According to the manually-operated sharpening apparatus, an operator is enabled to manually sharpen a workpiece portion such as a bladed portion of a scaler to have a proper angle by simply moving the sharpening member along the guide member in a state that the sharpening member attached to the guide member is abutted against a workpiece properly positioned with use of the positioning-assist element. Before and in the course of a sharpening operation, the operator is enabled to determine whether the angle of the workpiece portion coincides with a target angle on the basis of an extending direction of the straight member, relative to the second scale, of the assist device retained on the workpiece portion, with the shank of the workpiece positioned at the first scale. Furthermore, the assist device can be accurately retained on the workpiece portion sharpened flat by use of the sharpening member. In other words, the sharpening section cooperates with the assist device to achieve a synergistic effect of improving the assist-device retaining accuracy, i.e., the measurement accuracy.

According to still another aspect of the present invention, there is provided a manually-operated sharpening apparatus which comprises a sharpening section and an angle-measurement assist device. The sharpening section includes a base plate having a substantially flat face; a sharpening member for sharpening a workpiece portion of a workpiece, the workpiece portion to be sharpened being made of a magnetic material and provided in a distal end portion of a shank of the workpiece extending from a main body of the shank at a shank angle; a guide member, fixed on the substantially flat face of the base plate, for guiding the sharpening member attached thereto so as to permit the sharpening member to move therealong; a positioning-assist element including a positioning line drawn on the substantially flat face of the base plate and extending at a predetermined angle with respect to the guide member, for permitting an operator to orient the workpiece in a state where the predetermined angle is formed between the workpiece portion and the sharpening member. The angle-measurement assist device includes: a holder having a first flat face thereof adapted to be in contact with the workpiece portion to be subject to an angle measurement; a permanent magnet mounted to said holder for permitting said angle-measurement assist device to be magnetically retained on the workpiece portion; and a straight member projecting from a second face of said holder and having a size sufficiently greater than that of the workpiece portion.

According to the manually-operated sharpening apparatus, an operator is enabled to sharpen the workpiece portion to have a target angle by moving the sharpening member along the guide member and enabled to determine whether the angle of the workpiece portion coincides with the target angle based on an extending direction of the straight member of the assist device retained on the workpiece portion. Further, the angle-measurement assist device can be accurately retained on the workpiece portion sharpened flat to improve the measurement accuracy.

Preferably, the guide member is formed on the flat face of the base plate integrally therewith. Alternatively, the guide member is disposed on the flat face of the base plate so as to be pivotable around one end of the guide member, and is adapted to be fixed at an arbitrary pivotal angular position. More preferably, the guide section includes an arcuate member fixed to the flat face of the base plate. As the guide member is pivoted, another end of the guide member moves along the arcuate member.

According to the latter embodiment having the pivotable guide member, a manually-operated sharpening apparatus is provided, which is suitable for the sharpening and angle measurement of various workpieces having different shank shapes from one another. By using the guide member in the same manner as the rod member in the aforementioned angle measurement device, a visual measurement on the angle of the workpiece portion can be made.

DETAILED DESCRIPTION

With reference to FIGS. 1 to 6, an angle-measurement assist device according to a first embodiment of the present invention will be described.

The assist device is intended to assist a visual measurement on the blade angle of a dental scaler. The dental scaler is sharpened by use of, for example, a manually-operated sharpening apparatus described in Japanese patent application no. 10-101750 filed on Jul. 7, 1998 by the same assignees as those of this application and in U.S. Ser. No. 09/181,652 (issued as U.S. Pat. No. 6,146,257) filed on Oct. 29, 1998 by the same applicants as those of this application claiming the priority based on said Japanese patent application. The description of U.S. Ser. No. 09/181,652 is incorporated herein by reference.

Figure 1:
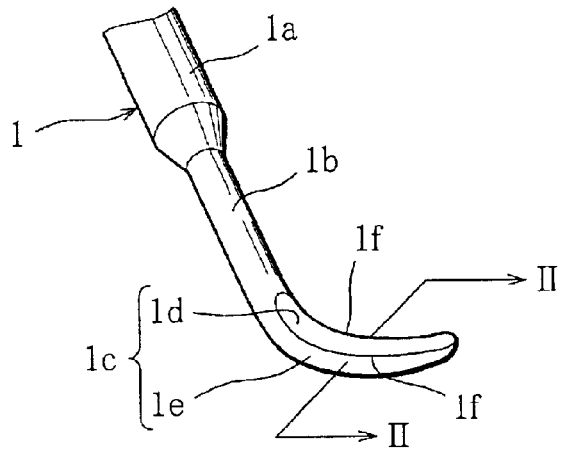
FIG. 1 is a fragmentary perspective view showing, by way of example, part of a scaler which is a typical angle measurement object.
Figure 2:
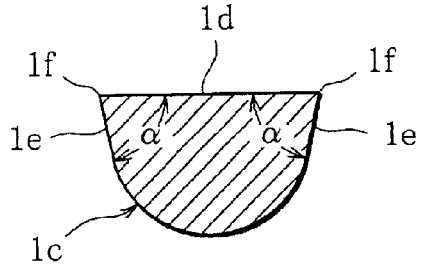
FIG. 2 is a cross sectional view showing a bladed portion of the scaler taken along line II—II in FIG. 1.

As shown in FIG. 1, the dental scaler 1 is comprised of a handle 1*a* grasped by an operator, a shank 1*b* extending therefrom, and a bladed portion 1*c* formed in a distal end portion of the shank 1*b*. As shown in FIG. 2, the bladed portion 1*c* is formed into a semi-cylindrical shape having a flat upper face 1*d* and a semi-cylindrical face 1*e* whose flat opposite edge portions cross the upper face 1*d* to form two ridge lines constituting two tips of the blade. In FIG. 2, symbol $\alpha$ represents a blade angle (sharpening angle). Preferably, the blade angle $\alpha$ has a value falling within a range from 70 deg to 80 deg. The blade angle of 78 deg is more preferable.

In this specification, an angle formed between the shank 1*b* and an upper face 1*d* of the bladed portion 1*c* is referred to as a shank angle. A Universal type scaler as shown in FIG. 1 has a shank angle of 90 deg, whereas a Gracey type scaler has a shank angle of 70 deg. A Gracey type scaler will be mentioned later with reference to FIG. 8.

As mentioned previously, a scaler is sharpened to have a proper blade angle. However, it is difficult for an operator to make a visual inspection promptly and accurately to determine whether the scaler has been sharpened to have a proper blade angle.

Figure 3:
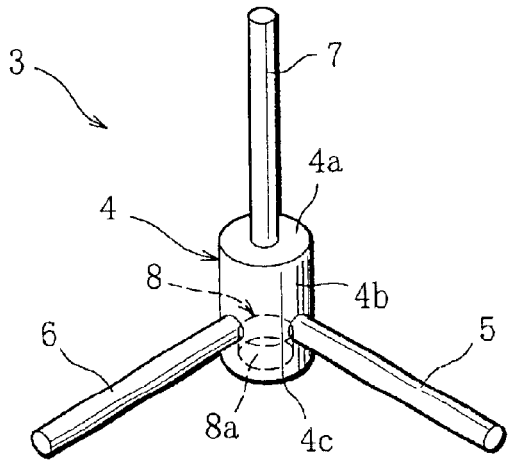
FIG. 3 is a perspective view of an angle-measurement assist device according to a first embodiment of the present invention.

The angle-measurement assist device of this embodiment is intended to assist such a visual inspection. As shown in FIG. 3, the assist device is comprised of a cylindrical holder 4; first, second and third pins (straight members) 5, 6 and 7 extending from the holder 4; and a permanent magnet 8 disposed in the holder 4. The permanent magnet 8 is arranged in such a manner that one magnetic pole or one end face 8*a* thereof is flush with a lower face 4*c* of the holder 4, so that the assist device may be magnetically retained on the bladed portion 1*c* of the shank 1*b* made of a magnetic material. Meanwhile, the permanent magnet 8 may be fixed, with adhesive, to the lower face 4*c* of the holder 4.

The first and second pins 5 and 6 project from a peripheral face 4*b* of the holder 4 to straightly extend in the directions perpendicular to each other. The third pin 7 projects from an upper face 4*a* of the holder 4 to straightly extend in the direction perpendicular to the first and second pins 5 and 6. These pins 5, 6 and 7 are not required to have the same length and may have appropriate lengths determined depending on the requirements of the angle-measurement assist device.

Since the angle-measurement assist device is employed together with the dental scaler 1, the device is configured to be compact. For instance, the holder 4 has about 4 mm diameter and about 6 mm length. Each of the pins 5, 6 and 7 has about 0.8 mm diameter and about 10 mm to 15 mm length. The permanent magnet 8 is formed into a circular disk shape which is about 1.5 mm to 3 mm in length and about 2 mm to 3 mm in height.

The holder 4 is made of a light weight, rust-resistant material such as synthetic resin, aluminum or stainless steel. Also, the pins 5, 6 and 7 are made of a light weight, rust-resistant material, preferably, aluminum, stainless steel, synthetic resin or the like.

In the meantime, the holder is not inevitably necessary to be formed into a cylindrical shape, and may be formed into other shapes such as a rectangular parallelepiped or a regular hexahedron. In this case, the pins 5, 6 and 7 are configured to extend from three adjacent faces of the holder, and the permanent magnet 8 is mounted to a face of the holder 4 on the side opposite to any one of the pins. The permanent magnet 8 is not necessary to be formed into a circular disk, and may be formed into an appropriate shape depending on the shape of the holder 4 and the like.

In the following, a visual inspection using the angle-measurement assist device 3 will be explained.

Figure 4:
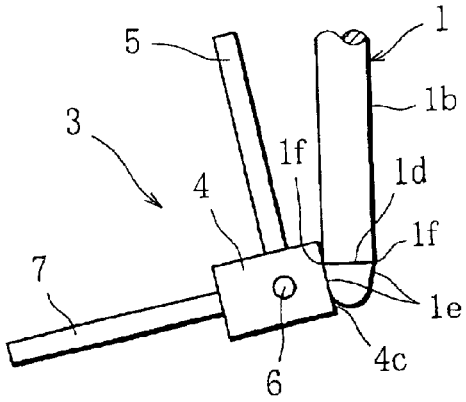
FIG. 4 is a front view showing the assist device of FIG. 3 in a state where it is retained on the bladed portion of the scaler.

For a visual inspection on the blade angle $\alpha$ of the Universal type scaler 1 shown in FIG. 1, the assist device 3 having the permanent magnet 8 is magnetically retained on the scaler 1 as shown in FIG. 4, with the lower face 4*c* of the holder 4 being in contact with one of the tips 1*f*, i.e., one of the flat opposite edge portions of the semi-cylindrical face 1*e* of the scaler 1.

By the way, most of dental scalers have their shanks and bladed portions made of a magnetic material such as stainless steel, and hence the angle-measurement assist device 3 mounted with the permanent magnet 8 can be magnetically retained on the bladed portions of these scalers.

Figure 5:
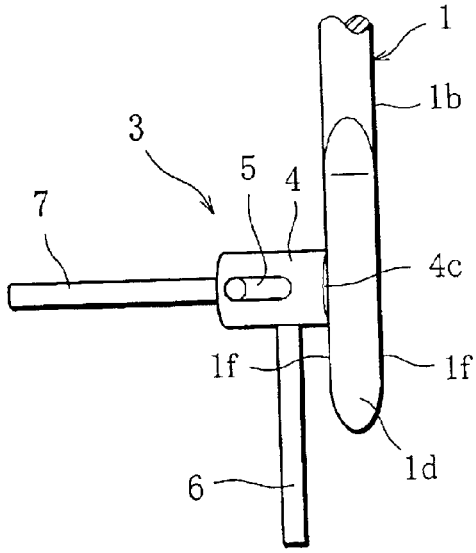
FIG. 5 is a plan view of the angle-measurement assist device retained on the scaler.

When the assist device 3 is retained on the scaler 1 as shown in FIG. 4, the first pin 5 extends upwardly at an angle relative to the axis of a main body of the shank 1*b* of the scaler 1, i.e., extends in substantially the same direction as the extending direction of the flat edge portion of the semi-cylindrical face 1*e* of the scaler 1. As shown in FIG. 5, the second pin 6 extends along the blade tip 1*f* of the scaler 1, and the third pin 7 extends perpendicularly to the extending direction of the blade tip 1*f*.

Each of the extending directions of the first and third pins 5 and 7 represents the blade angle (sharpening angle) a of the scaler 1, and each pin 5 or 7 is considerably greater in size than that part of the blade tip 1*f* which will be subject to an angle measurement. In other words, the blade angle $\alpha$ is indicated under magnification by the extending directions of the pins 5 and 7. Thus, an operator is enabled to visually determine an approximate value of the blade angle $\alpha$ on the basis of the extending direction of either one of these pins, especially, that of the first pin 5.

The operator can manually adjust the retained state of the angle-measurement assist device 3 on the bladed portion 1*c* of the scaler 1 so that the second pin 6 of the assist device 3 may extend in parallel to the bladed portion 1*c*, whereby the first pin 5 extends in the direction accurately indicating the blade angle of the scaler 1.

As understood from the foregoing explanation, it is not essentially required to provide the assist device 3 with three pins. An approximate value of the blade angle can be visually determined with use of an angle-measurement assist device provided with one or two pins.

Figure 6:
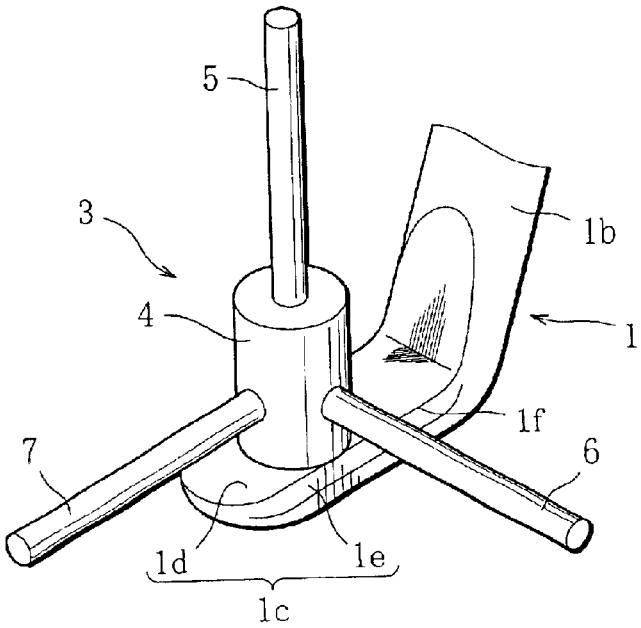
FIG. 6 is a perspective view showing the assist device in a state where it is placed on an upper face of the bladed portion of the scaler.

The operator is also permitted to make a visually inspection on the shape of the bladed portion 1*c* of the scaler 1 based on the extending directions of the pins 5, 6 and 7, with the angle-measurement device 3 retained on the upper face 1*d* of the bladed portion 1*c* of the scaler 1 as shown in FIG. 6. Such a visual inspection is useful to check a three-dimensionally complicated shape of the bladed portion 1*c*.

Figure 7:
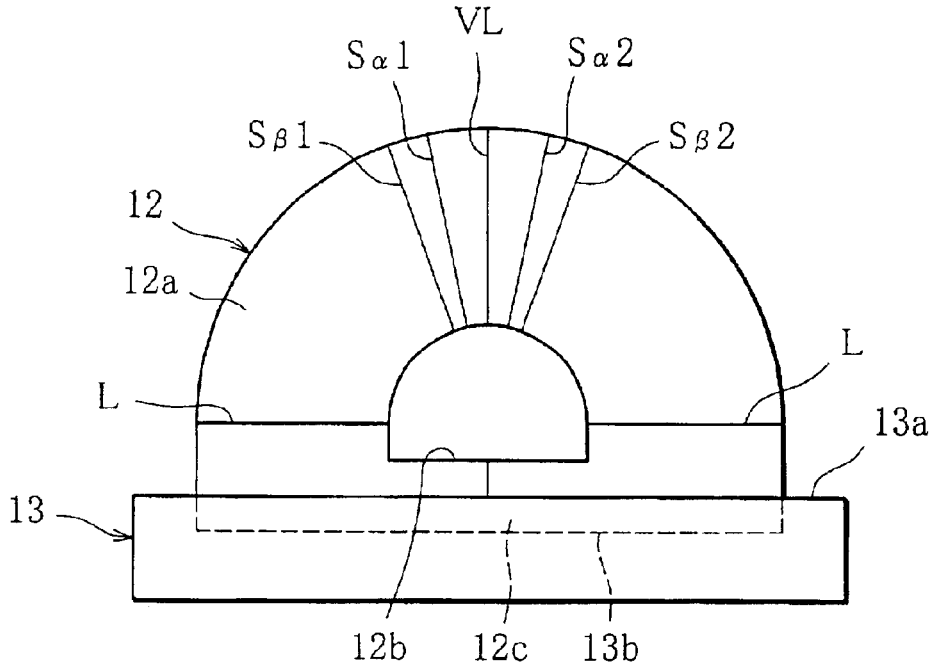
FIG. 7 is a front view showing a base plate and a scale plate of an angle measurement device according to a second embodiment of the present invention.
Figure 8:
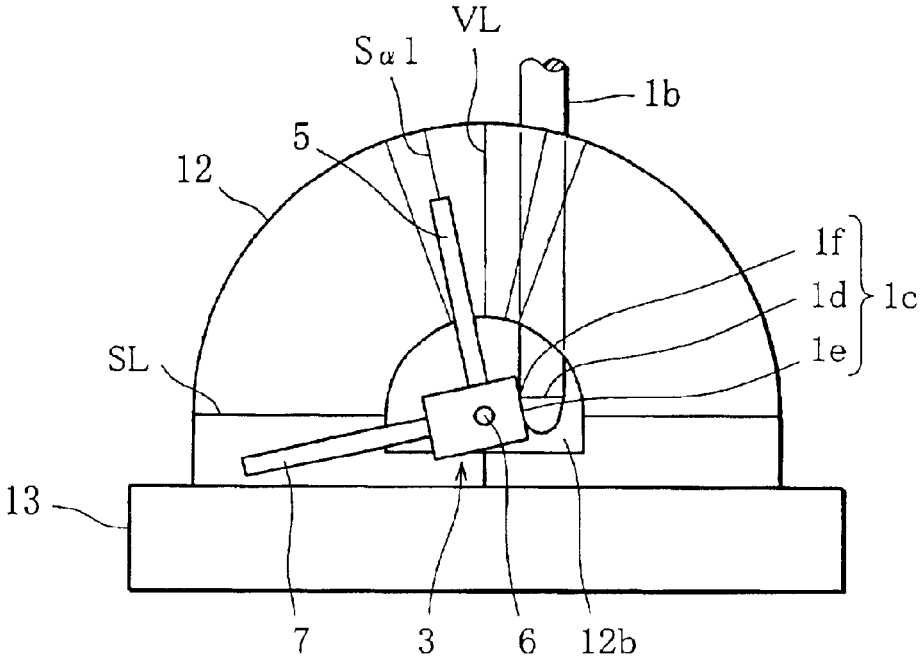
FIG. 8 is a front view showing the angle measurement device which is comprised of the angle-measurement assist device shown in FIG. 3 and the base and scale plates shown in FIG. 7, together with a Universal type scaler on which the assist device is retained.
Figure 9:
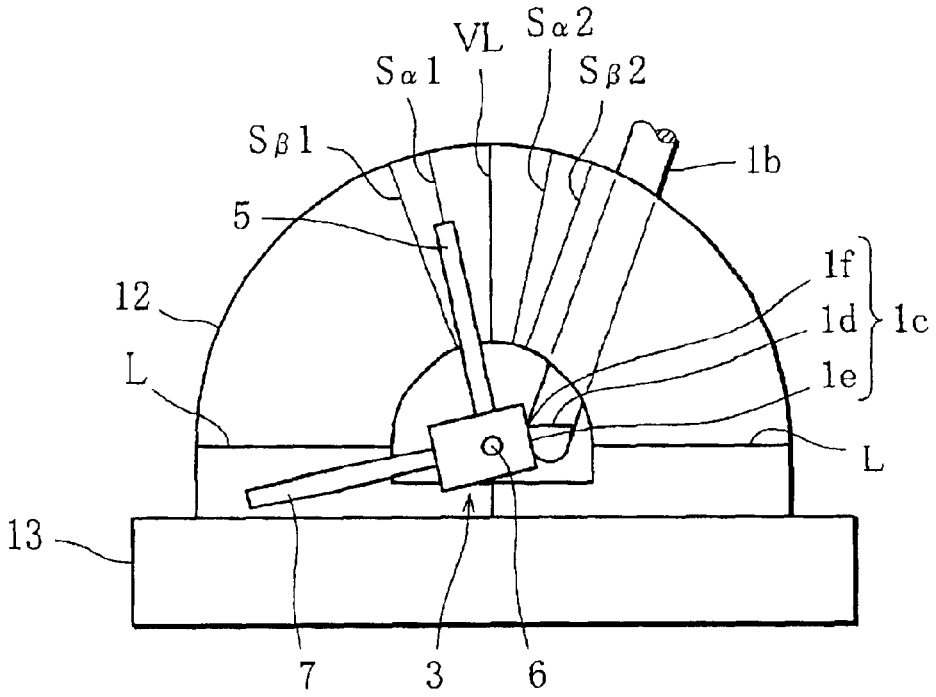
FIG. 9 is a front view showing the angle measurement device shown in FIG. 8, together with a Gracey type scaler.

With reference to FIGS. 7–9, an angle measurement device according to a second embodiment of the present invention will be explained.

The angle measurement device is comprised of the angle-measurement assist device shown in FIG. 3, a scale plate 12, and a base plate 13. As shown in FIG. 7, the scale plate 12 is formed into a semi-circular shape as a whole and has a central portion thereof formed with a semi-circular hole 12*b*. A plate face 12*a* of the scale plate 12 is provided with a reference line L extending in parallel to a lower edge of the scale plate 12, a vertical line VL serving as a first scale indicative of a target positioning angle for the main body of the shank of a Universal type scaler, and scales S$\beta$1, S$\beta$2 serving as the first scale for that of a Gracey type scaler. The scales s$\beta$1, s$\beta$2 extend at an angle of 70° relative to the reference line L. The plate face 12 of the scale plate 12 is also provided with scales S$\alpha$1, S$\alpha$2 serving as a second scale indicative of a target sharpening angle $\alpha$ to be established when the main body of the shank is positioned at the first scale. The scales S$\alpha$1, S$\alpha$2 extend at a target sharpening angle $\alpha$ of, e.g., 78° relative to the reference line L.

The scale plate 12 is constituted by, e.g., a transparent plastic plate, permitting the shank 1*b* to be seen therethrough. The scale plate 12 is configured to be removably mounted to the base plate 13, with a lower end portion 12*c* fitted into a groove 13*b* formed in the base plate 13. The reference line L formed in the scale plate 12 extends in parallel with the plate face 13*a* of the base plate 13 when the scale plate 12 is mounted to the base plate 13.

In the following, a visual measurement on the blade angle of a Universal type scaler by use of the angle measurement device will be explained.

After mounting the scale plate 12 to the base plate 13 placed on a desk or the like, an operator grasps the handle of the scaler 1, and inserts the bladed portion 1*c* of the scaler 1 into the hole 12*b* of the scale plate 12 as shown in FIG. 7. Then, the operator brings the holder 4 of the assist device 3 to be in contact at its flat face with a desired one of the flat opposite edge portions of the semi-cylindrical face 1*e* forming the bladed portion 1*c* of the scaler 1, whereby the assist device 3 is magnetically retained thereon. Next, the scaler 1 is positioned in such a manner that the main body of the shank of the scaler 1 extends in parallel to the vertical line VL of the scale plate 12 and the second pin 6 of the assist device 3 is located on an imaginary scale origin at which the reference line L crosses the vertical line VL. The positioning of the scaler 1 can be easily carried out since the scale plate 12 is transparent. Then, the operator makes a visual inspection to determine whether the angle of the blade if coincides with the target sharpening angle α (here, 78°) based on an extending direction, relative to the scale Sα1 provided in the scale plate 12, of the first pin 5 of the assist device 3 retained on the scaler 1.

For a visual inspection on the angle of another blade tip, the operator causes the assist device 3 to be retained on another flat edge portion of the semi-cylindrical face 1*e* of the bladed portion 1*c* and determines the blade angle based on an extending direction of the first pin 5 relative to the scale Sα2 which is symmetrical to the scale Sα1 with respect to the vertical line VL.

For a visual inspection on the blade angle of a Gracey type scaler, the assist device 3 is retained on a desired one of the flat opposite edge portions of the semi-cylindrical face 1*e* of the bladed portion 1*c* inserted through the hole 12*b* of the scale plate 12, and the shank 1*b* is positioned in parallel to the scale Sβ2, with the second pin 6 located at the imaginary scale origin of the scale plate 12. Under this state, the operator makes a visual inspection on the blade angle based on an extending direction of the first pin 5 relative to the scale Sα1. A visual inspection on another blade tip is made based on an extending direction of the first pin 5 relative to the scale Sα2.

As apparent from the foregoing explanations, the angle measurement device permits a visual inspection in respect of scalers having a right- or left-side edge or both the edges.

In the foregoing explanations, a case has been explained where a visual inspection is made with use of the scale plate 12 mounted to the base plate 13. Such a visual inspection may be made by using the scale plate 12 alone. In this case, an operator grasps the scaler 1 in one hand and holds the scale plate 12 in another hand. Thus, the base plate 13 is not essentially required in the angle measurement device of the present invention.

The angle measurement device according to the second embodiment may be modified variously.

For instance, the scale plate 12 may be provided with a third scale indicative of an angle corresponding to a supplementary angle of the target sharpening angle α. The third scale is provided at a lower part of the scale plate 12 below the reference line L. For a case where the target sharpening angle α is 78°, the angle indicated by the third scale is 12°. Whether the blade angle of the scaler 1 coincides with the target sharpening angle α can be determined based on an extending direction of the third pin 7 relative to the third scale, with the assist device 3 retained on the scaler 1.

In order to carry out a visual inspection on various types of scalers, the first scale and the second or third scale are provided in the scale plate 12 to meet shank angles and target sharpening angles of these scalers. In addition to those scales, angle graduations as in a protractor may be provided in the scale plate 12. Since various scales including angle graduations may be provided in the scale plate 12 in this manner, the extending directions of the pins 5–7 from the holder 4 of the assist device 3 can be set variously. For example, it is not essential to configure the three pins so as to extend in the directions perpendicular to one another. In such a case, desired scales are provided at angular positions suited to the extending direction of a pin for angle measurement. The angle-measurement assist device 3 may be provided with one or two pins since it is not essential to provide three pins in the assist device 3.

Figure 10:
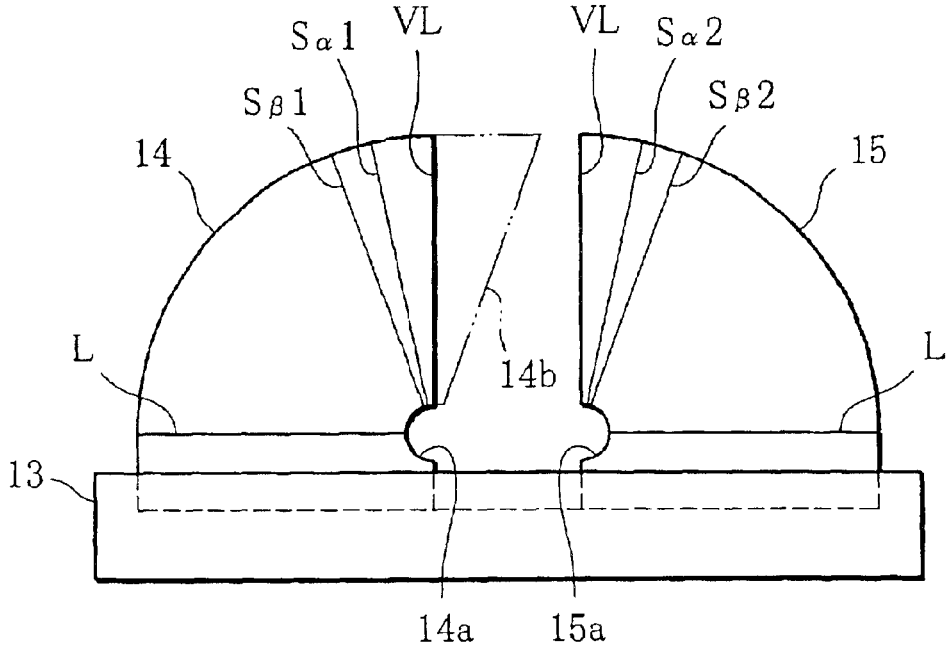
FIG. 10 is a front view showing a modification of the scale plate shown in FIG. 7.

FIG. 10 shows a scale plate according to a modification of the scale plate 12 shown in FIG. 7. The modified scale plate is comprised of first and second scale plates 14, 15 corresponding to the left and right halves of the scale plate 12, respectively. These scale plates 14, 15 are each formed into a quadrant shape and are mounted to the base plate 13 with a spacing therebetween. The first scale plate 14 is provided with a reference line L, a vertical line VL, and scales Sα1, Sβ1. Further, a notch 14*a* corresponding to the hole 12*b* of FIG. 7 is provided at that part of the first scale plate 14 at which imaginary extension lines of the reference line, vertical line and scales cross one another. The second scale plate 15 is provided with a reference line L, a vertical line VL, scales Sα2, Sβ2 and a notch 15*a*. The first and second scale plates 14, 15 may be coupled at their lower portions to each other. A visual inspection using the scale plates 14, 15 may be made in the same manner as in the case of the scale plate 12 of FIG. 7 being used. Hence, an explanation will be omitted.

As a further modification, the first scale plate 14 may be formed into a shape in which one edge 14*b* of the plate 14 extends in parallel with the scale Sβ2 of the second scale plate 15. In a visual inspection, the scaler 1 can be easily positioned by abutting the main body of the shank of the scaler 1 against the one edge 14*b* of the first scale plate 14. This applies to the second scale plate 15. The scale plate may be constituted solely by either the first scale plate 14 or the second scale plate 15.

Figure 11:
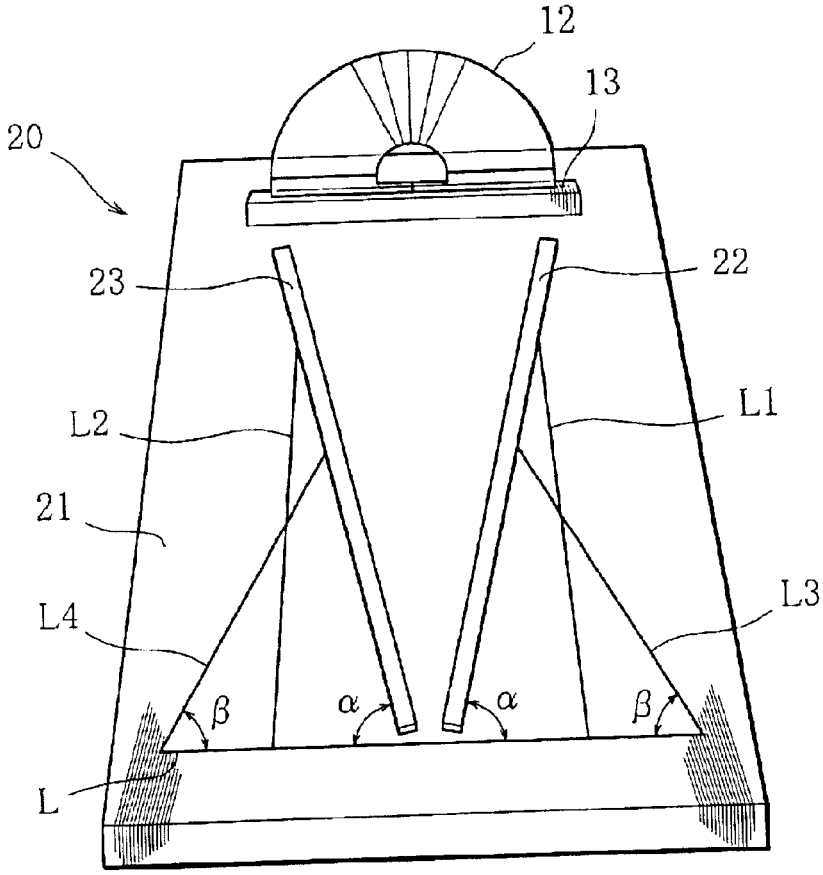
FIG. 11 is a perspective view of a manually-operated sharpening apparatus according to a third embodiment of the present invention.

With reference to FIG. 11, a manually-operated sharpening apparatus according to a third embodiment of the present invention will be explained.

The manually-operated sharpening apparatus is comprised of an angle-measurement assist device 3 as shown in FIG. 3, a scale plate 12 and a base plate 13 as shown in FIG. 7, and a sharpening section.

Figure 12:
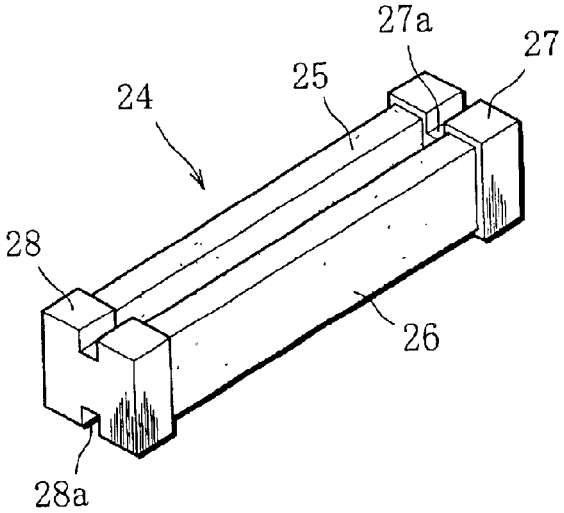
FIG. 12 is a perspective view of a sharpening stone of the sharpening apparatus shown in FIG. 11.

Referring to FIGS. 11 and 12, the sharpening section comprises a base plate 21 having a substantially flat face, a sharpening stone assembly 24 shown in FIG. 12 for sharpening a workpiece portion to be sharpened (in this embodiment, a bladed portion 1*c* of a scaler 1 shown in FIG. 1), guide members 22, 23 for movably guiding the sharpening stone assembly 24, and a positioning-assist element for permitting an operator to orient the scaler 1 in a state a predetermined angle, i.e., a target sharpening angle α is formed between the scaler 1 and the guide member 22 or 23.

The base plate 13 for the scale plate 12 is fixed on the flat face of the base plate 21. The guide members 22, 23 are fixed on the flat face of the base plate 21 and each obliquely extend at the target sharpening angle θ (78 deg, for instance) with respect to a reference line L drawn on the flat face of the base plate 21. In this embodiment, the positioning-assist element is comprised of positioning lines L1–L4 drawn on the flat face of the base plate 21. The positioning lines L1, L2 for a Universal type scaler extend from the reference line L to the guide members 22, 23 at right angles relative to the line L. The positioning lines L3, L4 for a Gracey type scaler extend from the reference line L to the guide members 22, 23 at the same angle as the shank angle β of the scaler, i.e., 70 deg relative to the line L. A number of pairs of positioning lines may be provided to make it easy to accurately position various types of scalers including a scaler that has a shank thereof formed into a three-dimensionally curved shape.

As shown in FIG. 12, the sharpening stone assembly 24 is comprised of two sharpening stones 25, 26 each formed into a square pillar shape and each having opposite ends thereof mounted with caps 27 and 28, whereby the sharpening stones 25, 26 are supported in parallel to each other with a predetermined gap therebetween. The caps 27, 28 are formed at their upper and lower faces with guide grooves 27*a*, 28*a* to which the guide member 22 or 23 can be fitted, whereby the sharpening stone assembly 24 is permitted to be slid along the guide member 22 or 23.

To sharpen the left-side blade tip of a Universal type scaler by use of the aforementioned manually-operated sharpening apparatus, an operator places the sharpening section 20 on a desk or the like, and causes the guide grooves 27*a*, 28*a* of the sharpening stone assembly 24 to be engaged with the guide member 22, with the assembly 24 positioned in the vicinity of a proximal end of the guide member 22, as shown in FIG. 11. Then, the operator grasps the handle 1*a* of the scaler 1 and positions the main body of the scaler shank on the positioning line L1, with the tip end of the bladed portion 1*c* directed upward and the upper face 1*d* directed frontward to extend in parallel to the reference line L. In this state, the left-side blade tip if (i.e., the left flat edge portion of the semi-cylindrical face 1*e* of the bladed portion 1*c*) is brought in contact with the sharpening stone 26, whereby the blade tip 1*f* abuts against the sharpening stone 26 at the target sharpening angle α. The operator reciprocates the sharpening stone assembly 24 as shown by arrows A and B, thereby sharpening the blade tip 1*f*.

Before and in the course of a sharpening operation, the operator makes a visual inspection to confirm a blade angle of the scaler 1 in accordance with the inspection processes using the assist device 3 as previously mentioned with respect to the foregoing second embodiment, and finishes the sharpening operation when the blade tip 1*f* has been sharpened to have the target sharpening angle α.

For the sharpening of the right-side blade tip, the sharpening stone assembly 24 is reciprocated along the guide member 23, with the shank of the scaler 1 positioned on the positioning line L2 and the sharpening stone 25 abutted against the blade tip 1*f*. As for a Gracey type scaler, the left- or right-side blade tip is sharpened in similar processes in a state where the shank is positioned on the positioning line L3 or L4.

For simplicity, the guide members 22, 23 and the positioning lines L1–L4 can be used for angle measurement instead of the scale plate 12 and the base plate 13. That is, an angle measurement may be constituted by the angle-measurement assist device 3, the guide members 22, 23 and the positioning lines L1–L4. A visual inspection to determine whether the blade angle of a Universal type scaler coincides with a target angle can be carried out by determining whether an extending direction of the first pin 5 of the assist device 3 retained on the scaler positioned on the positioning line L1 or L2 (corresponding to the aforesaid first scale) coincides with an extending direction of the guide member 22 or 23 (corresponding to the aforesaid second scale). For a Gracey type scaler, the positioning lines L3, L4 are employed instead of the lines L1, L2.

Figure 13:
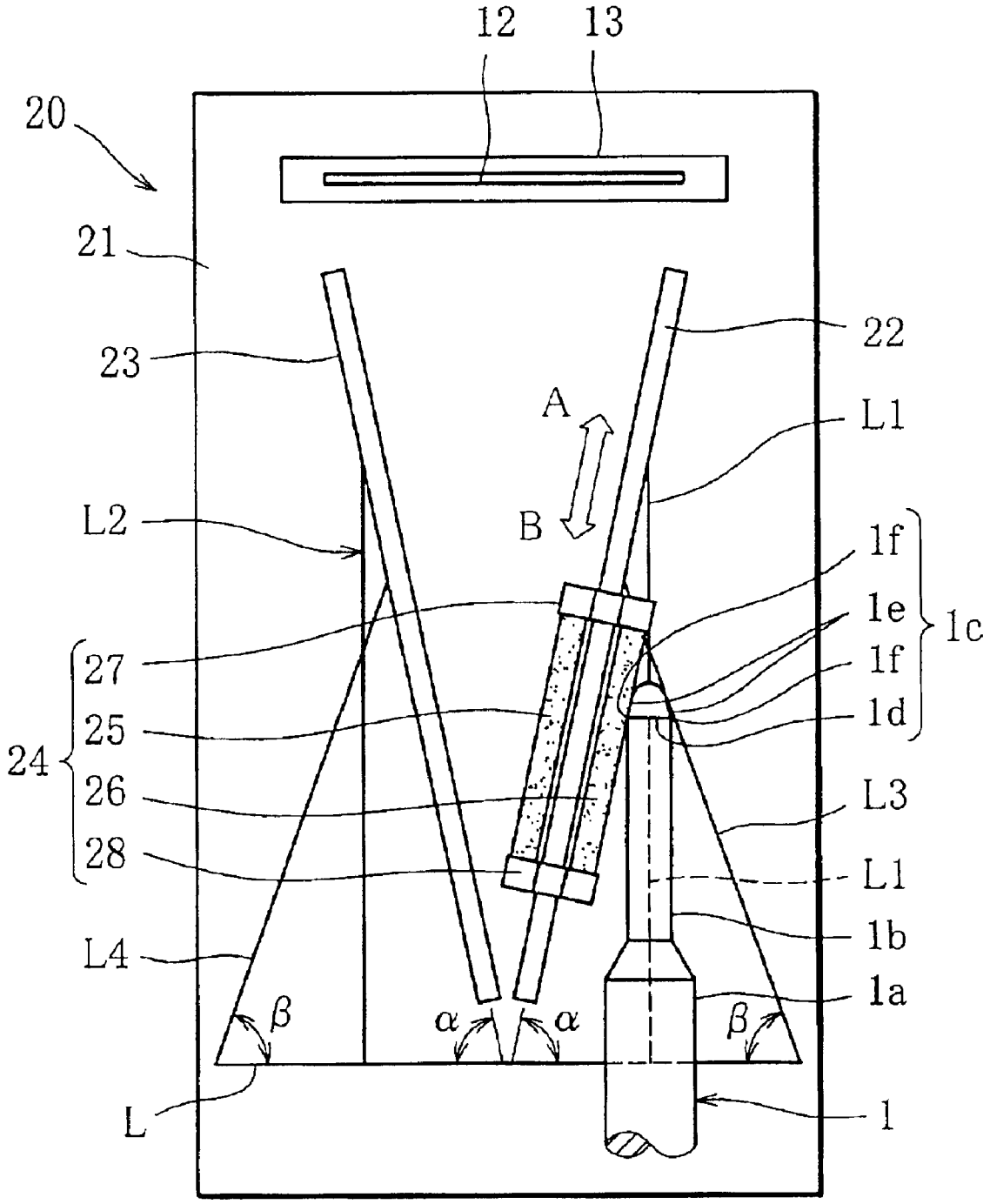
FIG. 13 is a plan view for explaining an operation of the sharpening apparatus shown in FIG. 11.
Figure 14:
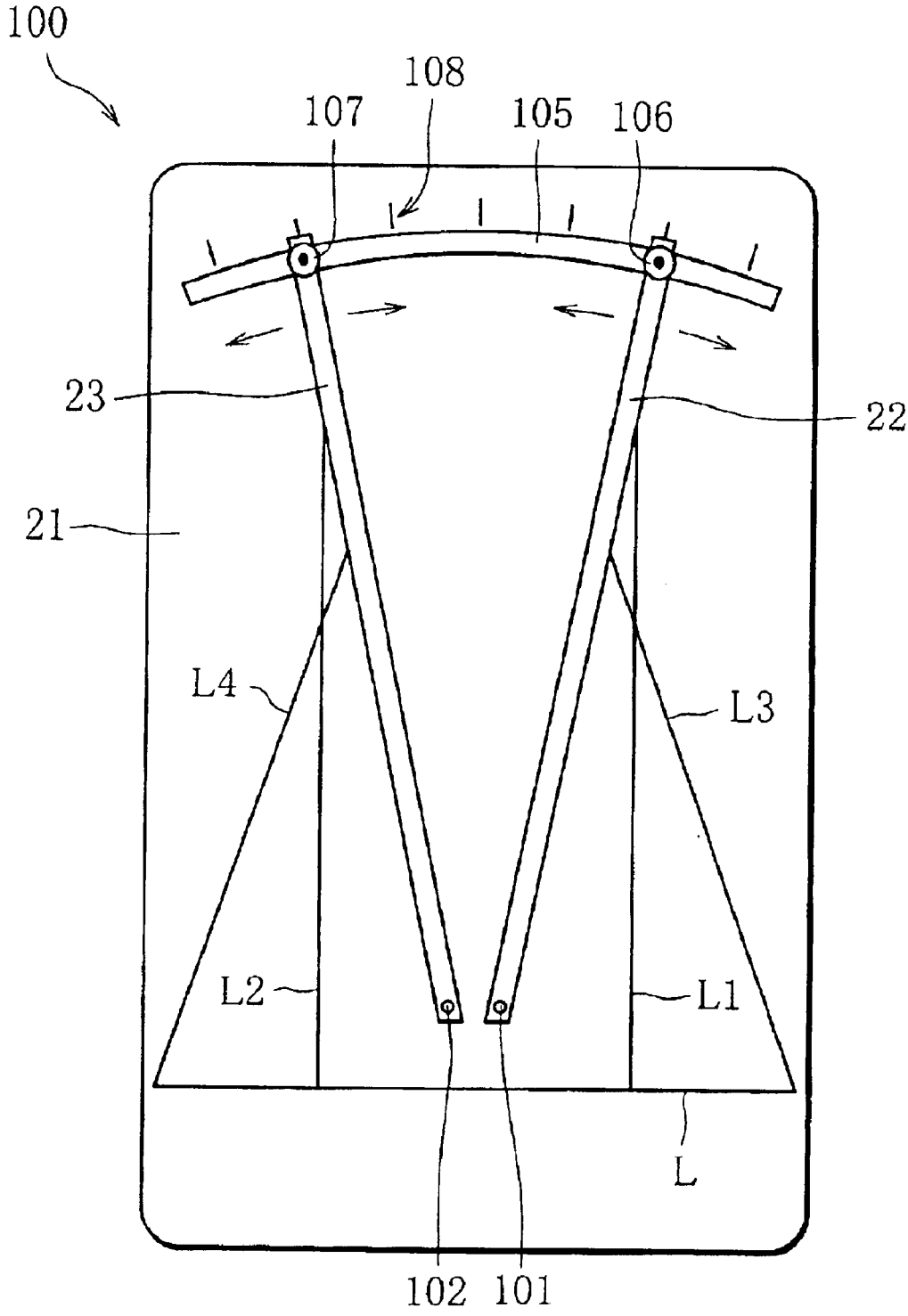
FIG. 14 is a plan view showing part of a sharpening section of a manually-operated sharpening apparatus according to a fourth embodiment of the present invention.

With reference to FIG. 13, a manually-operated sharpening apparatus according to a forth embodiment of the present invention will be explained.

The sharpening apparatus (shown at reference numeral 100 in FIG. 13) has substantially the same basic construction as that of the sharpening apparatus of the third embodiment, but is different therefrom in that an angle formed between each guide member 22 or 23 and the longitudinal axis of the base plate 21 is variable and that the scale plate 12 and the base plate 13 are not provided.

Specifically, the guide members 22, 23 are pivotally supported on the base plate 21 at their proximal end portions by means of pins 101 and 102. These guide members are formed at their distal end portions with grooves (not shown) for receiving an arcuate member 105 fixed to the surface of the base plate 21. Further, the guide members are formed with screw holes into which screws 106 and 107 are threadedly engaged. On the surface of the base plate 21, a reference line L1 and two pairs of positioning lines L1, L2; L3, L4 are drawn. On the side remote from the guide members 22, 23 with respect to the arcuate member 105, an angular index 108 is formed on the surface of the base plate 21.

The operator is permitted to move the distal end portions of the guide members 22, 23 along the arcuate member 105 as shown by arrow in FIG. 13 while pivoting the guide members 22, 23 around the pins 101 and 102, respectively, to thereby vary the angles formed between the guide members and the longitudinal axis of the base plate 21. The pivotal angular positions of the guide members 22, 23 can be temporally fixed by fixing the distal end portions of the guide members to the circular member 105 by tightening the screws 106, 107. Sharpening work can be made in substantially the same manner as in the case of the third embodiment, and hence explanations are omitted herein.

A visual inspection can be carried out by using the guide members 22, 23 and the positioning line L1–L4 to determine whether the blade angle of a scaler coincides with a target angle, as in the case of the simplified inspection in the third embodiment.

Moreover, a measurement on the blade angle of a scaler 1 can be performed by pivoting the guide member (rod member) 22 or 23 along the arcuate member 105 so that an extending direction of the guide member coincides with that of the first pin 5 of the assist device 3 that is retained on the bladed portion 1*c* of the scaler 1 and by comparing the extending direction of the guide member with the angle graduations 108 provided around the arcuate member 105.

Of course, the scale plate 12 and the base plate 13 for angle measurement as shown in FIG. 11 may be provided in the sharpening apparatus of the forth embodiment. Alternatively, angle graduations may be formed on the surface of the base plate 21 of the sharpening section, in addition to the positioning lines L1–L4.

The present invention is not limited to the aforesaid angle-measurement assist device, the angle measurement device and the sharpening apparatus for dental scalers according to the first through fourth embodiments and their modifications, and may be modified in various manners. For instance, the present invention is applicable to an angle-measurement assist device, an angle measurement device and a manually-operated sharpening apparatus for use with a measurement object other than dental scalers.

What is claimed is:

1. An angle-measurement assist device comprising:

a holder having a first flat face thereof adapted to be in contact with a portion of a measurement object, the portion being subject to an angle measurement and made of a magnetic material;

a permanent magnet mounted to said holder for permitting said device to be magnetically retained on the measurement object portion; and a straight member projecting from a second face of said holder, extending substantially in parallel with the first flat face and having a size sufficiently greater than that of the measurement object portion.

2. The angle-measurement assist device according to claim 1, wherein the measurement object is a dental scaler having a handle adapted to be grasped by an operator and a shank extending therefrom and having a distal end portion thereof formed with a bladed portion which constitutes the measurement object portion.

3. The angle-measurement assist device according to claim 1, further comprising:

a second straight member projecting from a third face of said holder which is different from or the same as the second face of said holder, wherein said second straight member has a size sufficiently greater than that of the measurement object portion.

4. An angle-measurement assist device comprising:

a holder having a first flat face thereof adapted to be in contact with a portion of a measurement object, the portion being subject to an angle measurement and made of a magnetic material;

a permanent magnet mounted to said holder for permitting said device to be magnetically retained on the measurement object portion; and a straight member projecting from a second face of said holder and having a size sufficiently greater than that of the measurement object portion:

second and third straight members each projecting from a third face of said holder which is different from or the same as the second face of said holder, wherein each of said second and third straight members has a size sufficiently greater than that of the measurement object portion.

5. An angle measurement device comprising:

an angle-measurement assist device including: a holder having a first flat face thereof adapted to be in contact with a portion of a measurement object, the portion being subject to an angle measurement, made of a magnetic material, and provided in a distal end portion of a shank of the measurement object which extends from a main body of the shank at a shank angle; a permanent magnet mounted to said holder for permitting said angle-measurement assist device to be magnetically retained on the measurement object portion; and a straight member projecting from a second face of said holder, extending substantially in parallel with the first flat face and having a size sufficiently greater than that of the measurement object portion; and a scale plate having a central portion thereof formed with a hole permitting the distal end portion of the shank to pass therethrough and being provided with a first scale indicative of a target positioning angle for the main body of the shank and a second scale indicative of a target angle of the measurement object portion which is to be established when the main body of the shank is positioned at the first scale.

6. The angle measurement assist device according to claim 5, further including:

a base plate for supporting said scale plate in a state that said scale plate vertically extends from said base plate.

7. An angle measurement device comprising:

an angle-measurement assist device including: a holder having a first flat face thereof adapted to be in contact with a portion of a measurement object, the portion being subject to an angle measurement, made of a magnetic material, and provided in a distal end portion of a shank of the measurement object which extends from a main body of the shank at a shank angle; a permanent magnet mounted to said holder for permitting said angle-measurement assist device to be magnetically retained on the measurement object portion; and a straight member projecting from a second face of said, extending substantially in parallel with the first flat face holder and having a size sufficiently greater than that of the measurement object portion;

a base plate being provided with a first scale indicative of a target positioning angle for the main body of the shank and a second scale indicative of a target angle of the measurement object portion which is to be established when the main body of the shank is positioned at a first scale.

8. The angle measurement device according to claim 7, wherein first and second lines serving as the first and second scales are drawn on said base plate.

9. The angle measurement device according to claim 7, further including a scale plate provided with the first and second scales and adapted to be disposed on said base plate.

10. An angle measurement device comprising:

an angle-measurement assist device including: a holder having a first flat face thereof adapted to be in contact with a portion of a measurement object, the portion being subject to an angle measurement, made of a magnetic material, and provided in a distal end portion of a shank of the measurement object which extends from a main body of the shank at a shank angle; a permanent magnet mounted to said holder for permitting said angle-measurement assist device to be magnetically retained on the measurement object portion; and a straight member projecting from a second face of said holder, extending substantially in parallel with the first flat face and having a size sufficiently greater than that of the measurement object portion;

a base plate being provided with a scale indicative of a target positioning angle for the main body of the shank and angle graduations.

11. The angle measurement device according to claim 10, wherein a rod member is disposed on said base plate so as to be pivotable around one end of said rod member.

12. An angle measurement device comprising:

an angle-measurement assist device including: a holder having a first flat face thereof adapted to be in contact with a portion of a measurement object, the portion being subject to an angle measurement, made of a magnetic material, and provided in a distal end portion of a shank of the measurement object which extends from a main body of the shank at a shank angle; a permanent magnet mounted to said holder for permitting said angle-measurement assist device to be magnetically retained on the measurement object portion; and a straight member projecting from a second face of said holder having a size sufficiently greater than that of the measurement object portion;

a base plate being provided with a scale indicative of a target positioning angle for the main body of the shank and angle graduations, wherein a rod member is disposed on said base plate so as to be pivotable around one end of said rod member;

wherein an arcuate member is fixed on said base plate, and another end of said rod member moves along said arcuate member as said rod member is pivoted.

13. A manually-operated sharpening apparatus comprising:

a sharpening section including: a base plate having substantially flat face; a sharpening member for sharpening a portion of a workpiece, the portion to be sharpened being made of a magnetic material and provided in a distal end portion of a shank of the workpiece extending from a main body of the shank at a shank angle, a guide member, fixed on the substantially flat face of said base plate, for guiding said sharpening member attached thereto so as to permit the sharpening member to move therealong; a positioning-assist element including a positioning line drawn on the substantially flat face of said base plate and extending at a predetermined angle with respect to said guide member, for permitting an operator to orient the workpiece in a state where the predetermined angle is formed between the workpiece portion and the sharpening member;

an angle-measurement assist device includes: a holder having a first flat face thereof adapted to be in contact with the workpiece portion to be subject to an angle measurement; a permanent magnet mounted to said holder for permitting said angle-measurement assist device to be magnetically retained on the workpiece portion; and a straight member projecting from a second face of said holder, extending substantially in parallel with the first flat face and having a size sufficiently greater than that of the workpiece portion; and a scale plate having a central portion thereof formed with a hole permitting the distal end portion of the shank to pass therethrough, and being provided with a first scale indicative of a target positioning angle for the main body of the shank and a second scale indicative of a target angle of the measurement object portion which is to be established when the main body of the shank is positioned at the first scale.

14. A manually-operated sharpening apparatus comprising:

a sharpening section including: a base plate having substantially flat face; a sharpening member for sharpening a portion of a workpiece, the portion to be sharpened being made of a magnetic material and provided in a distal end portion of a shank of the workpiece extending from a main body of the shank at a shank angle; a guide member, fixed on the substantially flat face of said base plate, for guiding said sharpening member attached thereto so as to permit the sharpening member to move therealong; a position-assist element including a positioning line drawn on the substantially flat face of said base plate and extending at a predetermined angle with respect to the guide member, for permitting an operator to orient the workpiece in a state where the predetermined angle is formed between the workpiece portion and the sharpening member; and an angle-measurement assist device including: a holder having a first flat face thereof adapted to be in contact with the workpiece portion to be subject to an angle measurement; a permanent magnet mounted to said holder for permitting said angle-measurement assist device to be magnetically retained on the workpiece portion; and a straight member projecting from a second face of said holder, extending substantially in parallel with the first flat face and having a size sufficiently greater than that of the workpiece portion.

15. The manually-operated sharpening apparatus according to claim 14, wherein said guide member is formed on the flat face of said base plate integrally therewith.

16. A manually-operated sharpening apparatus comprising:

a sharpening section including: a base plate having substantially flat face; a sharpening member for sharpening a portion of a workpiece, the portion to be sharpened being made of a magnetic material and provided in a distal end portion of a shank of the workpiece extending from a main body of the shank at a shank angle; a guide member, fixed on the substantially flat face of said base plate, for guiding said sharpening member attached thereto so as to permit the sharpening member to move therealong; a position-assist element including a positioning line drawn on the substantially flat face of said base plate and extending at a predetermined angle with respect to the guide member, for permitting an operator to orient the workpiece in a state where the predetermined angle is formed between the workpiece portion and the sharpening member; and an angle-measurement assist device including: a holder having a first flat face thereof adapted to be in contact with the workpiece portion to be subject to an angle measurement; a permanent magnet mounted to said holder for permitting said angle-measurement assist device to be magnetically retained on the workpiece portion; and a straight member projecting from a second face of said holder and having a size sufficiently greater than that of the workpiece portion; wherein said guide member is disposed on the flat face of said base plate so as to be pivotable around one end of said guide member, and is adapted to be fixed at an arbitrary pivotal angular position.

17. The manually-operated sharpening apparatus according to claim 16, further including:

an arcuate member fixed to the flat face of said base plate, wherein another end of said guide member moves along said arcuate member as the guide member is pivoted.

18. The manually-operated sharpening apparatus according to claim 17, wherein the flat face of said base plate is provided with angle gradations around said arcuate member.

* * * * *